United States Patent [19]

Lapsker

[11] 4,361,987

[45] Dec. 7, 1982

[54] APPARATUS FOR HIGH TOLERANCE POLISHING OF A WORK-PIECE SURFACE

[75] Inventor: Itzchak Lapsker, Givatayim, Israel

[73] Assignee: GAL International Industries Inc., Forest Hills, N.Y.

[21] Appl. No.: 114,297

[22] Filed: Jan. 22, 1980

Related U.S. Application Data

[63] Continuation-in-part of Ser. No. 832,623, Sep. 12, 1977, abandoned.

[30] Foreign Application Priority Data

Oct. 29, 1976 [IL] Israel ..... 50794

[51] Int. Cl.[3] ..... B24B 5/00

[52] U.S. Cl. ..... 51/90; 51/330; 51/358

[58] Field of Search ..... 51/90, 364, 330, 401; 407/7, 61

[56] References Cited

U.S. PATENT DOCUMENTS

| | | | |
|---|---|---|---|
| 1,011,991 | 12/1911 | Moser | 51/90 |
| 1,498,224 | 6/1924 | Atwood | 125/5 |
| 1,519,876 | 12/1924 | Phelps | 407/61 |
| 2,023,572 | 12/1935 | Brendel | 51/90 |
| 2,024,591 | 12/1935 | Manchester | 51/401 |
| 2,054,311 | 9/1936 | Adams | 407/7 |
| 2,259,685 | 10/1941 | Elsloo | 51/364 |
| 2,546,490 | 3/1951 | Baldwin | 51/90 X |
| 2,649,648 | 8/1953 | Pinto | 407/61 |
| 2,885,766 | 5/1959 | Ernst | 407/7 |
| 3,329,065 | 7/1967 | Vaughn | 407/7 |

FOREIGN PATENT DOCUMENTS

| | | | |
|---|---|---|---|
| 497412 | 3/1937 | United Kingdom | 51/90 |

*Primary Examiner*—Harold D. Whitehead

*Attorney, Agent, or Firm*—Browdy and Neimark

[57] ABSTRACT

A method for polishing a workpiece comprising the steps of providing a polishing element formed of a volume of abrasive containing resilient material and causing the polishing element to move rapidly against a workpiece surface under pressure. Apparatus for carrying out the method is also disclosed.

15 Claims, 25 Drawing Figures

APPARATUS FOR HIGH TOLERANCE POLISHING OF A WORK-PIECE SURFACE

This is a continuation-in-part of U.S. patent application Ser. No. 832,623, filed Sept. 12, 1977, now abandoned.

FIELD OF THE INVENTION

The present invention relates to surface finishing tools and more particularly to polishing tools as distinct from cutting tools.

BACKGROUND OF THE INVENTION

Conventional techniques for precision machining of metal surfaces require that a workpiece be subjected to a conventional machining operation in a first machine and than be transferred to a second machine for a precision grinding and polishing operation. The required use of at least two processing machines involving the transfer of the workpiece from one to the other adds significantly to the time and cost involved in precision surface finishing and limits the quality which can be achieved. It is therefore desired to provide apparatus which is capable of producing a precision finished surface while requiring the use of only a single machine tool having replaceable polishing elements.

There are known tool heads comprising freely rotating cup cutters. Examples of such devices are shown in USSR Pat. Nos. 261873 and 272791 of 1970. There are also known tool heads for use in association with a metal lathe and comprising freely rotating round cutters. These are illustrated in "Progressive Methods of Rotating Cutting of Metals" Minsk 1972, USSR. None of the known devices described above is capable of producing surface smoothness in the desired range of between 2 and 4 microinch r.m.s.

The present invention seeks to overcome disadvantages of the known prior art devices described above and provides tool heads for use in machine tools for producing high precision finishes in the range of 2–4 microinch r.m.s. or higher.

There are also known cutting tools which are provided with freely rotatable finishing heads. One example of such a tool is shown in U.S. Pat. No. 2,885,766 (Ernst et al.) which describes a face milling cutter including cutting rollers having finishing grooves as well as other grooved cutting rollers all of which are freely rotatable on a base and arranged for rotation in one direction on the spindle of a milling tool. Such tools are designed for fine cutting of metal surfaces and produce a finish no better than 32 microinch r.m.s. They are entirely distinct from polishing tools which are capable of producing a much finer quality surface finish.

Various types of finishing rollers are known and presently in use. U.S. Pat. No. 2,259,685 shows a finishing roller which comprises a resilient core surrounded by a rigid metal plate on the outside surface of which is disposed a thin layer of abrasive material. U.S. Pat. No. 2,024,591 describes an abrasive wheel comprising a resilient inner portion coated with a relatively thin abrasive layer.

SUMMARY OF THE INVENTION

There is provided in accordance with embodiment of the invention an apparatus for polishing a workpiece comprising a polishing element comprising a volume of abrasive-containing resilient material and causing the polishing element to move rapidly against a workpiece surface under pressure.

Further, in accordance with an embodiment of the invention the polishing element defines a wheel or disc, which is mounted for relatively free rotation with respect to the workpiece. In accordance with a preferred embodiment of the invention the polishing element is rotatably mounted on a base which itself is rotated about an axis thereby to provide a constant rotational motion of the polishing element with respect to the workpiece surface. Preferably the rotating base is arranged for rotation in both directions as to enable provision of an extremely high quality surface finish of the order of 4–2 microinch r.m.s.

Additionally in accordance with the embodiment of the invention the polishing element may be constructed in a conical configuration and arranged so that the wear along the generatrix of the element is generally even.

According to a preferred embodiment of the invention one or more polishing elements are rotatably mounted within a housing which is disposed so as to collect particulate matter produced in the polishing process from wear of the polishing element during the polishing process. The presence of such particulate matter is extremely harmful to the machinery and to the quality of the surface finish. The housing may be constructed to have openings arranged to accomodate the polishing elements and to permit a portion of the elements to extend outwardly therefrom, the openings being of smaller overall dimensions than that of the maximum cross section of the polishing elements.

Additionally in accordance with an embodiment of the invention the housing may be provided with a movable bottom so as to accomodate changes in the outer diameter of the polishing element due to wear thereof, thereby enabling the use of the polishing element over a wide range of diameters, thus notwithstanding significant wearing thereof.

In order to compensate for the loss in resiliency due to reduction in the cross section of the resilient material as the element wears, the polishing element may be provided with a truncated-conical cross section, thereby to present increased width and thus similar resiliency with decreasing diameter.

Further in accordance with an embodiment of the invention the interior of the housing may be configured to define a particle collecting recess arranged to receive particulate matter generated in the polishing process and to retain it adjacent the outer wall of the housing with the aid of the centrifugal force generated by rotation of the housing during operation.

Additionally in accordance with an embodiment of the invention the polishing element may comprise an inner core of natural or synthetic rubber, preferably having resiliency greater than 75 on the Shore scale.

BRIEF DESCRIPTION OF THE DRAWINGS

The invention will be more fully understood and appreciated from the following detailed description taken in conjunction with the drawings in which:

FIG. 23 is a schematic illustration of a polishing tool particularly suitable for the polishing of inner races of bearings and the like.

DETAILED DESCRIPTION OF THE INVENTION

Figure 1:
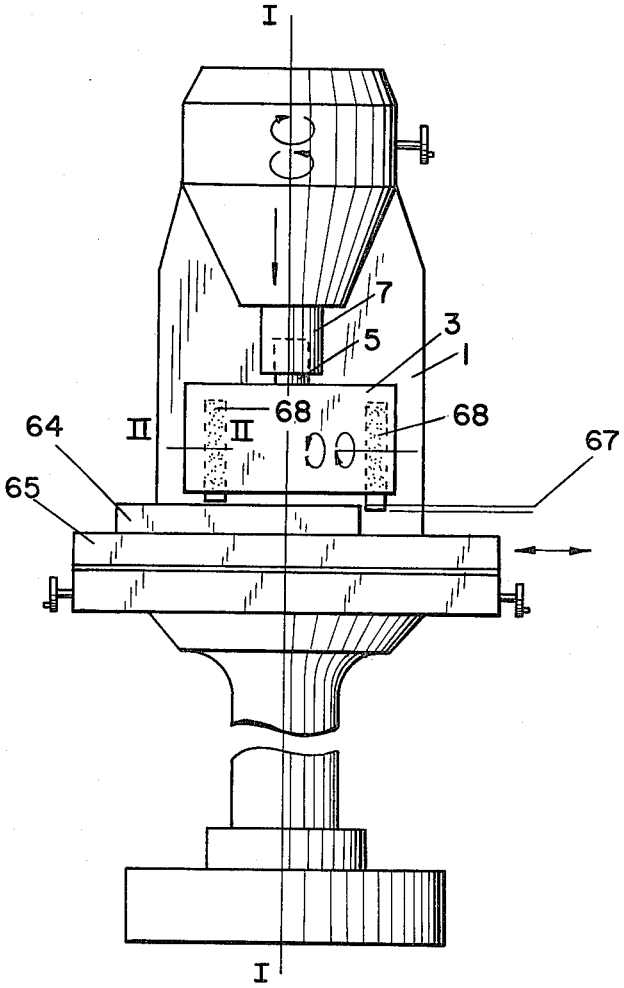
FIG. 1 is a pictorial illustration of polishing apparatus associated with a workpiece and mounted onto a rotary milling machine of conventional construction.

There are a number of known techniques for polishing workpieces. These may be generally classified into three groups: mechanical, chemical-mechanical and electro-erosion. Mechanical techniques include for example, grinding and rotational and vibratory polishing. Such mechanical techniques are accomplished using an abrasive material mounted or otherwise located on a rigid core and in the absence of appreciable pressure. Chemical-mechanical polishing is accomplished for example using a felt or leather contact element and a chemical-abrasive sludge which is brought into contact with the workpiece by the action of the contact element. Electro-erosion employs an electro-chemical reaction for surface treatment. None of the known polishing techniques employs a resilient abrasive polishing element applied to a workpiece under pressure.

In contrast to the above-described known techniques for polishing, the present invention provides polishing employing a resilient abrasive member maintained in relative motion with respect to a workpiece surface. It may be appreciated that every workpiece's surface when examined microscopically defines peaks having troughs defined therebetween. These peaks are produced by earlier, less precise finishings, such as that produced by the apparatus of U.S. Pat. No. 2,885,766 (Ernst et al.) or any other similar conventional lathe or milling cutter. The abrasive resilient polishing element engages the workpiece surface in a manner such that portions of the polishing elements enter the troughs between the peaks and thus bring the abrasive grains into contact therewith.

The fact that the polishing element is formed of a resilient rather than a rigid material causes the polishing action to break off the tips of the peaks at a location above the depth of penetration of the resilient material between the peaks.

In accordance with a preferred embodiment of the invention pressure engagement is produced between the polishing element and the workpiece such that approximately 200–300 microns of compression is produced in the polishing element thereby providing an area rather than line contact between the polishing element and the workpiece surface. It is appreciated that due to the resilient nature of the polishing element, the polishing technique provides a reduction of only approximately 0.001 mm. Therefore, the present invention makes it possible to polish the working surface without substantially changing the tolerances of the workpiece, which have been achieved in the previous processing.

As will be described hereinafter, the polishing element, in accordance with a preferred embodiment of the invention undergoes a complex motion with respect to the workpiece which greatly adds to the quality of the surface polishing finish. This complex motion comprises the rotation of the housing or base onto which the polishing element is mounted, the rotation of each polishing element about its own axis and the motion of the workpiece on a movable table relative to the polishing element. According to a preferred embodiment of the invention the polishing technique includes rotation of the base or housing in opposite directions which may correspond to opposite directions of the workpiece movement on the movable table.

It summary it may be appreciated that the technique of the apparatus of the present invention approximates, insofar as possible, the motion and exceeds the result produced by hand polishing in which random directional engagement between a polishing element and a workpiece surface is provided.

Reference is now made to FIG. 1 which illustrates polishing apparatus constructed in accordance with an embodiment of the invention in operative association with a conventional milling machine for rotational engagement under pressure with a workpiece. The polishing apparatus in indicated generally by reference numeral 1 and comprises a body portion 3 and a shank portion 5 which is insertable into the chuck of the milling machine 7 for rotation selectably in opposite directions about the spindle axis I—I of the milling machine.

It is appreciated that the workpiece, indicated by reference numeral 64 is preferably mounted on a movable table 65 associated with the milling machine. Normally the polishing apparatus is rotated initially in a first direction while the movable table moves in a first longitudinal direction. Thereafter, as the table returns in an opposite direction, the rotation of the polishing apparatus may be in an opposite direction. The two direction rotation capability of the polishing apparatus thus provides an extremely high quality surface finish of the order of 2-4 microinch rms with evenly, randomly directed polishing marks.

The pressure engagement of the polishing apparatus with the workpiece surface is illustrated in FIG. 1 by the extent 67 to which the polishing element indicated by reference numeral 68 is compressed when it engages the workpiece surface. It is noted by reference to FIG. 1 that a compression of approximately 200-300 microns in the overall diameter of the polishing element is produced. According to a preferred embodiment of the invention, in all the embodiments shown in FIGS. 1-23, the pressure is extended perpendicular to the workpiece surface.

The polishing apparatus which is the subject of the present invention will now be described in greater detail with reference to FIGS. 2 and 3. The apparatus comprises a housing 71 which is fixedly attached to a shank portion 73. Disposed mainly within the housing 71 are a pair of polishing elements 75 typically in the form of annular disks. Elements 75 are mounted rigidly onto respective axles 77 which in turn are bearing mounted within the housing for relatively free rotation with respect thereto.

Figure 2:
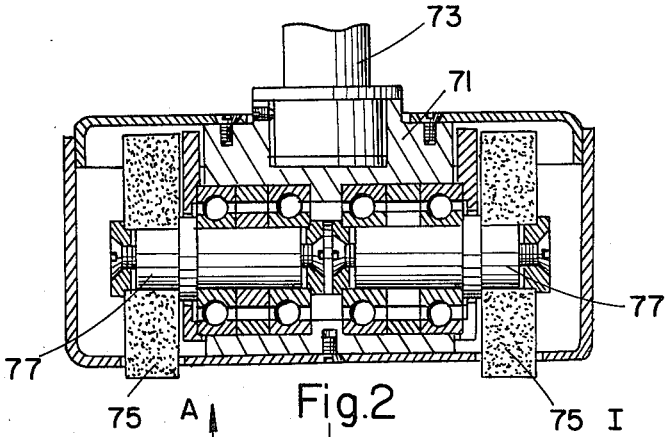
FIG. 2 is a sectional side view illustration of a polishing device constructed and operative in accordance with an embodiment of the invention.
Figure 3:
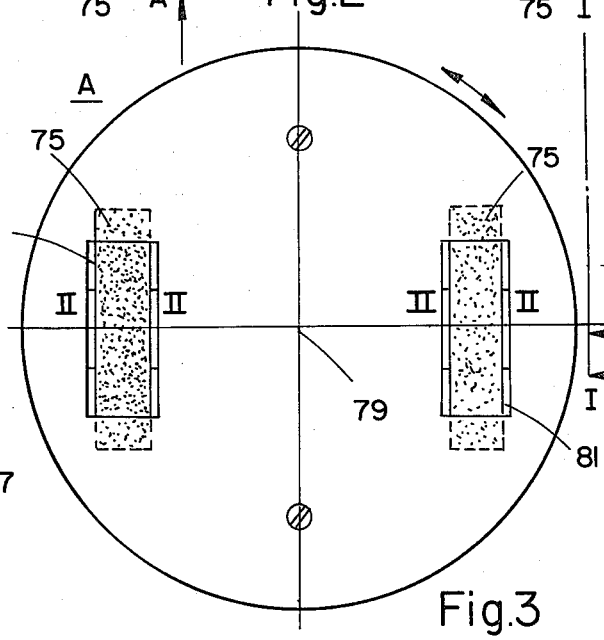
FIG. 3 is a bottom view of the polishing device of FIG. 2.
Figure 4:
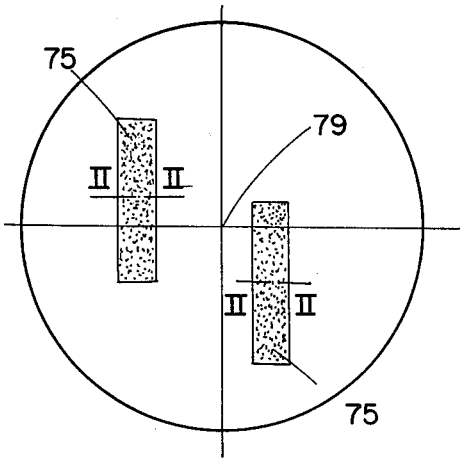
FIG. 4 is a bottom view illustration of an alternative embodiment of a polishing device.

The construction of the apparatus of FIG. 2 is essentially similar to that of the apparatus of FIGS. 10-14 having resilient finishing elements except for the provision of the housing. It is noted in FIG. 3 that the axes of rotation of both polishing elements 75 are identical and intersect with the axis of rotation of the housing, indicated by reference numeral 79. According to a preferred embodiment of the invention illustrated schematically in FIG. 4, the axes of rotation of the polishing elements 75 do not intersect that of the housing. The separation of each of the axes of rotation of the polishing elements from axis 79 may differ, as illustrated in FIG. 4 or be the same.

The non-intersection feature provides an additional vector moment of motion between the polishing element and the workpiece surface when housing 71 is driven in rotary pressured motion against the workpiece surface.

It is noted that the polishing elements 75 are disposed mainly within housing 71 and only a portion thereof extends outside of the housing, through openings 81 formed in the bottom surface of the housing. Openings 81 are constructed to be of as small an area as possible and therefore have a width only slightly greater than that of the polishing elements sufficient to prevent interference with the free rotation thereof. The length of the openings is less than the diameter of the polishing elements.

The above construction is designed to cause particulate matter generated in the polishing operation from wear of the polishing element to be gathered into the interior of housing 71 so as not to interfere in the polishing operation and produce uneven results and damage the machinery.

Figure 5:
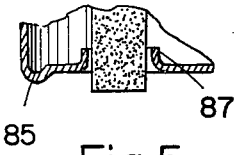
FIG. 5 is a detailed illustration of a portion of a polishing device constructed and operative in accordance with an embodiment of the invention.

A preferred construction of the interior of housing 71 is illustrated in FIG. 5 where a recess 85 is defined at the inner periphery of the housing for collection of particulate matter along the outermost portions of the interior of the housing under the influence of centrifugal forces produced by the high speed rotation of the housing during operation.

The portions 87 of the housing bottom surface adjacent the polishing elements are bent upwardly to define a barrier for prventing, insofar as possible, particulate matter from escaping from the housing. Clearly the housing is constructed to be readily opened for cleaning after use.

Four different types of polishing elements each suitable for a different type of workpiece material were tested. It is appreciated that for varying purposes, the ratio of and size of abrasive grains and the resiliency of the element may be varied, along with other characteristics thereof.

Figure 6:
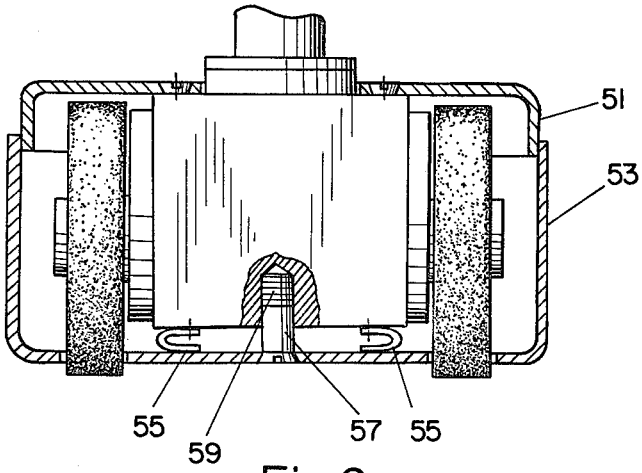
FIG. 6 is a partially cut away illustration of a polishing device constructed and operative in accordance with an alternative embodiment of the invention.

It is appreciated that during operation of the polishing apparatus, the polishing elements become worn. In order to render the use of such elements economical, it is proposed to provide a housing having a movable bottom so as to accomodate changes in the outer diameter of the polishing element and to enable such element to be used notwithstanding a significant decrease in its diameter due to wear. Such a housing is illustrated in FIG. 6 and comprises a fixed top portion 51 and a bottom and side portion 53 which is spring mounted onto the top portion by a pair of bent leaf springs 55 and a screw fastener 57. Screw fastener 57 may be inserted by a desired amount into a corresponding socket 59 fixed with respect to the top portion, thereby defining the disposition of the bottom surface of the housing in accordance with the state of wear of the polishing elements.

Figure 7:
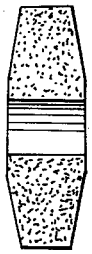
FIG. 7 is an illustration of a polishing element constructed and operative in accordance with an embodiment of the invention.

Referring now to FIG. 7, there is seen a cross sectional illustration of a polishing element constructed and operative in accordance with a preferred embodiment of the invention in a generally annular configuration having a truncated conical cross section of increasing width with decreasing radius. This design is intended to maintain operating characteristics of the element somewhat constant notwithstanding wearing down and consequent reduction of the diameter of the element during use. Thus, as the element is worn down the same effective width and pressure is supplied to the workpiece.

Figure 8:
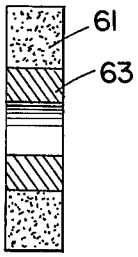
FIG. 8 is an illustration of a polishing element constructed and operative in accordance with an alternative embodiment of the invention.

FIG. 8 shows an alternative form of polishing element comprising an outer annular ring 61 of uniform resilient abrasive material surrounding an inner core 63 of a relatively more resilient material, preferably with a resiliency greater than 75 on the Shore scale. The inner core 63 may be constructed of natural rubber, for example.

Figure 9:
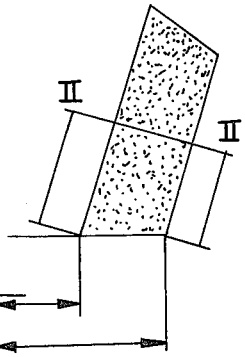
FIG. 9 is an illustration of a conical polishing element arranged to provide generally even wear.

FIG. 9 illustrates the use of a conical polishing element of uniform resilient abrasive composition which is arranged such that the radius of the element about its axis II—II of rotation decreases with an increasing distance from the axis I—I of rotation of the housing. Thus the absolute value of the velocity of rotation at all points along the polishing element is generally the same. Thus, generally uniform wear of the polishing element is achieved, with the result that high quality surface finishing can be provided.

Figure 10:
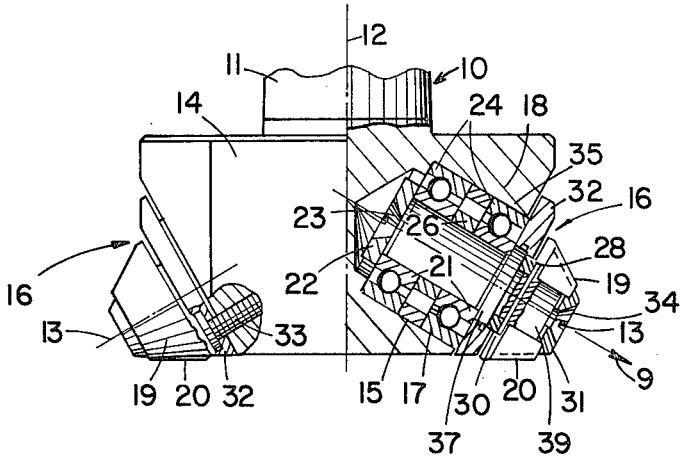
FIGS. 10–13 are partially cut away elevation views of portions of polishing tools constructed and operative in accordance with various different embodiments of the invention.

Referring now to FIG. 10 there is shown a millshaving head 10 constructed and operative in accordance with an ambodiment of the invention. Millshaving head 10 comprises a shank 11 which is suitable for insertion into the chuck of a conventional machine tool providing a rotating drive such as a machine tool of the "machining centre" type. Shank 11 is disposed about a longitudinal axis 12 which defines the axis of rotation of the entire millshaving head.

Hereinafter, the terms "finishing roller" and "shaver roller" will be employed interchangeably to designate the element which contacts the workpiece surface. According to an embodiment of the invention finishing rollers 19 may be formed with an abrasive outer surface. Such rollers may comprise a relatively soft, elastic base formed for example of a resinoid, rubber or a porous polyurethane. Grains of abrasives such as, for example, diamond, borozone, and silicone carbide are fixedly attached to the base to define a finishing surface.

The construction of cutting assemblies 16 will now be described in detail. A spindle 17 is arranged for relatively free rotation in housing 14 about axis 13 and is mounted on a pair of angular ball bearings 24 which are maintained in a desired disposition by spacing rings 15 and 26. Typically spacing ring 15 is wider than ring 26 thus causing the extreme outer ends of bearing 24 to incline slightly inwardly towards spindle 17. Spindle 17 is secured to the inner, freely rotating bearing surfaces 21 of bearings 24 and prevented from axial movement relative thereto in a direction indicated by arrow 9 by means of a clamp member 22. Clamp 22 is affixed to spindly 17 by means of a screw 23. Bearings 24 and the associated spindle 17 are in turn secured to housing 14 by means of a retaining member 32 which is engaged by a plurality of screws 33 which extend through member 32 and thread into housing 14.

Shaver rollers 19 are fixed to spindle 17 for rotation together therewith by means of a retaining member 31 which is engaged by a screw 34. Shaver roller 19 is prevented from slipping with respect to spindle 17 by means of a retaining pin 30 inserted through a suitable recess in shaver roller 19 and extending through spindle 17.

Spindle 17 comprises a first portion 35 which contacts the inner surface of bearing 24, a bulkhead portion 37 against which the shaver roller 19 is seated and a shaft portion 39 which extends through an aperture in the shaver roller for secure mounting thereof and into which is threaded screw 34. Intermediate bulkhead portion 37 and shaver 19 there is provided a compensating washer 28 which can be ground to a precisely selectable thickness. The purpose of washer 28 is to enable orientation of surface 20 to shaver roller 19 into the precise plane desired to ensure that surfaces 20 of the respective shaver rollers contact the workpiece surface along contact paths lying in substantially the same plane here referred to as "the contact plane." The contact plane is preferably selected to lie substantially perpendicular to axis 12. In this case and where axis 13 intersects axis 12, the acute angle between the contact plane and axis 13 is the complement of the acute angle defined between axes 13 and 12.

It will be appreciated that the surface of rotation 20 may comprise a cylindrical or conical surface of a surface of any other suitable configuration.

Briefly summarizing the operation of the millshaving head hereinabove described, it is seen that rotation of the millshaving head 10 about axis 12 when surfaces 20 of respective shaver rollers 19 contact a workpiece surface causes the shaver rollers to rotate freely with respect to housing 14 about their respective axes of rotation 13. It is appreciated that the instantaneous speed of rotation of any given point of surface 20 is the vector sum of the speed of rotation of that point about axis 12 and the speed of rotation of that point about axis 13. It may thus be understood that each point on surface 20 moves at a different instantaneous speed with the result that at least a portion of surface 20 moves in relative sliding movement against the workpiece surface.

Figure 11:
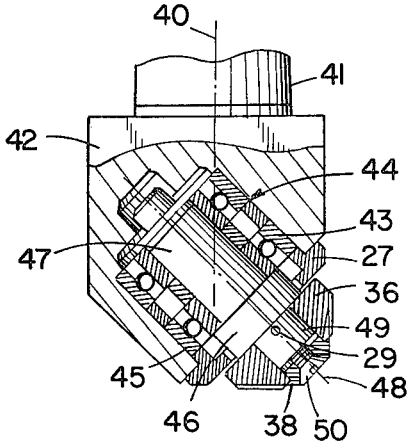

Referring now to FIG. 11 there is shown a millshaving head particularly suitable for the machining of surfaces to which access is limited and relatively difficult. The head comprises a shank 41 adapted for insertion into operative engagement with a chuck of a rotating drive machine tool for rotation about an axis 40. Supported on shank 41 is a housing 42 having formed therein a bore 43. Disposed within bore 43 is a bearing assembly 44 which is identical in all relevant respects to the bearings 24 and spacer rings 15 and 26 illustrated in FIG. 10 and described in the corresponding discussion hereinabove.

Mounted on bearing assembly 44 for generally free rotation with respect to housing 42 is a spindle 47 which lies along an axis of rotation 48 which intersects axis 40. Spindle 47 comprises a body portion 45 which is affixed to the inner bearing surfaces of assembly 44 for rotation together therewith, a bulkhead portion 46 and a shaft portion 49 in which is threaded a screw 50 which together with a retaining member 38 firmly holds a finishing roller 36 against bulkhead portion 46. Hereinafter the terms "finishing roller" and "shaver roller" will be employed interchangeably to designate the elements which contact the workpiece surface. Relative rotation between shaver roller 36 and spindle 47 is prevented by the provision of a retaining pin 29. The bearing assembly 44 and thus the shaver roller 36 is secured within housing 42 by means of retaining means 27. Shaver roller 36 is oriented such that it defines a finishing surface 23 which lies in a plane substantially perpendicular to axis 40. It is thus appreciated that the angle between respective axes 40 and 48 is the complement of the acute angle defined between the finishing surface 23 of roller 36 and axis 48.

It is appreciated that various types of bearings may be substituted for the bearings 24 illustrated in FIGS. 10 and 11. For example relatively narrow needle bearings may be employed and held in place by conventional mounting rings. Additionally, thrust bearings may be disposed intermediate spindle 47 and back to recess 43. Such bearings typically comprise two facing grooved discs together defining a bearing race and having balls disposed therebetween and arranged about axis 48 at the rear of housing 43. As a further alternative to bearings 24 or needle bearings, a sliding bearing or bushing may be installed between spindle 47 at the interior walls of housing 43.

Figure 12:
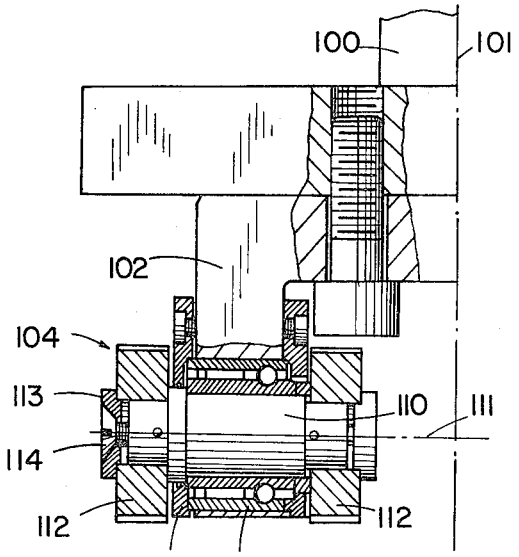

FIG. 12 shows one-half of a millshaving head which represents a variation in the design of a millshaving head of a type illustrated hereinbefore in which shaving rollers are disposed on both sides of the bearing assembly rather than on a single side thereof as in the embodiments illustrated in FIGS. 1 and 2. About a central shank 100 arranged for rotation about an axis 101 there is fixed a mounting support 102 to which is fixedly coupled in turn a cutting assembly 104. Cutting assembly 104 comprises a bearing support assembly 106 for mounting of cylindrical bearings 108 which may comprise combined radial thrust bearings as shown. A spindle 110 is disposed for relatively free rotation with respect to support 106. At the extreme ends of spindle 110 there are mounted finishing rollers 112 which may be any suitable type of finishing roller. In the embodiment shown in FIG. 12, spindle 110 is arranged to rotate about an axis 111 which is perpendicular to and intersects the axis of rotation 101 of shank 100. Finishing rollers 112 may be secured onto spindle 110 for rotation therewith by any suitable means, preferably including a retaining member 113 held against finishing roller 112 by means of a screw 114 which threads into spindle 110.

Figure 13:
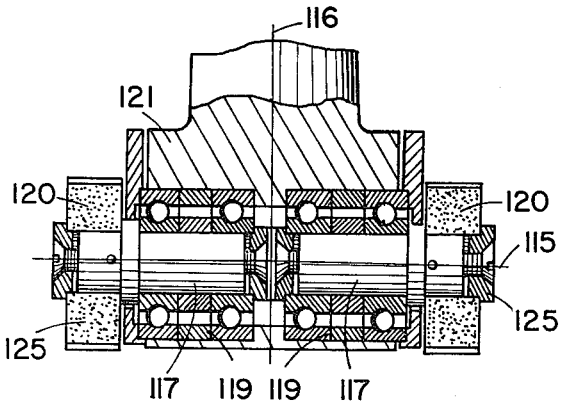

Referring now to FIG. 13 there is shown a millshaving head having a pair of cylindrical finishing rollers 120 mounted for rotation about an axis 115 which is perpendicular to and intersects a rotational axis 116 of the entire millshaving head. A pair of spindles 117 are mounted on respective assemblies 119 in a housing 121 and finishing rollers 120 are fixedly attached to the respective spindles by suitable retaining means 125 for fixed rotation of the finishing rollers 120 together with their respective spindles. It is appreciated that in this type of configuration any suitable type of finishing rollers may be employed.

Figure 14:
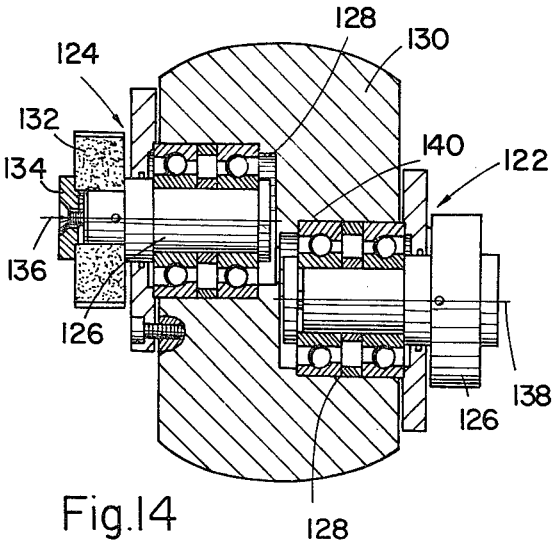
FIG. 14 is a partially cut away bottom view of the polishing tool illustrated in FIG. 13.

Referring now to FIG. 14 there is shown a millshaving head which differs from those illustrated in FIGS. 10–13 hereinabove described in that the axes of rotation of the shaver rollers do not intersect the axis of rotation of the entire millshaving head, but rather are offset therefrom by a given amount. As will be described hereinafter this arrangement offsets the vector sum of cutting speeds attained by various portions of the shaving rollers.

As seen in the partially cut-away bottom view of FIG. 14 the axis of rotation of millshaving head housing 130 is indicated by reference number 140. A pair of cutting assemblies 122 and 124 each comprise a bearing mounted spindle 126 partially disposed in a recess 128 formed in housing 130. A finishing roller 132 is mounted with the assistance of retaining meams 134 in a generally conventional manner unto the portion of spindle 126 which extends outside of recess 128. Cutting assembly 124 is arranged for rotation about an axis 136 while cutting assembly 122 is arranged for rotation about an axis 138. Both axes 136 and 138 are generally perpendicular to axis 140 and do not intersect axis 140. Rather the axes of rotation of the cutting assemblies are offset from axis 140 by a predetermined amount. Here axes 136 and 138 are offset from axis 140 by an equal amount and lie parallel to each other. It is appreciated that in alternative embodiments of the invention the amounts of offset need not be equal and the axes of rotation of the individual cutting assemblies need not necessarily be parallel to each other.

It is appreciated that details of the construction of cutting assemblies 122 and 124 may be selected in accordance with the desired application and may be substantially as shown in connection with any of previously described FIGS. 10–13.

It is appreciated that finishing of a workpiece surface using a millshaving head such as that described hereinabove follows preliminary cutting of the surfaces on a conventional machine tool. The conventional cutting tool is removed and a millshaving head of the present invention is inserted in its place. The grooves of the grooved shaver rollers or alternatively the abrasive grains of abrasive type rollers act as cutting edges as they slide in motion relative to the workpiece surface.

It is also appreciated that embodiments of the invention may be constructed such that the axes of respective shank and shaver roller rotation either do or do not intersect.

It is appreciated that shaver rollers may also be provided having a relatively soft substrate covered with grains of abrasive borazone, or diamonds.

It should be understood that in all of the embodiments illustrated herein the shaver rollers rotate in contact with the workpiece surface and are functionally driven thereby. The cutting speed, i.e. the speed at which a given point on the finishing surface of the shaver roller slides with respect to the workpiece surface is represented by the resultant of the geometrical sum of vectors representing the velocity of the rotation of the point about the axis of rotation of the shank plus the speed of the point about its own axis of rotation.

Figure 15:
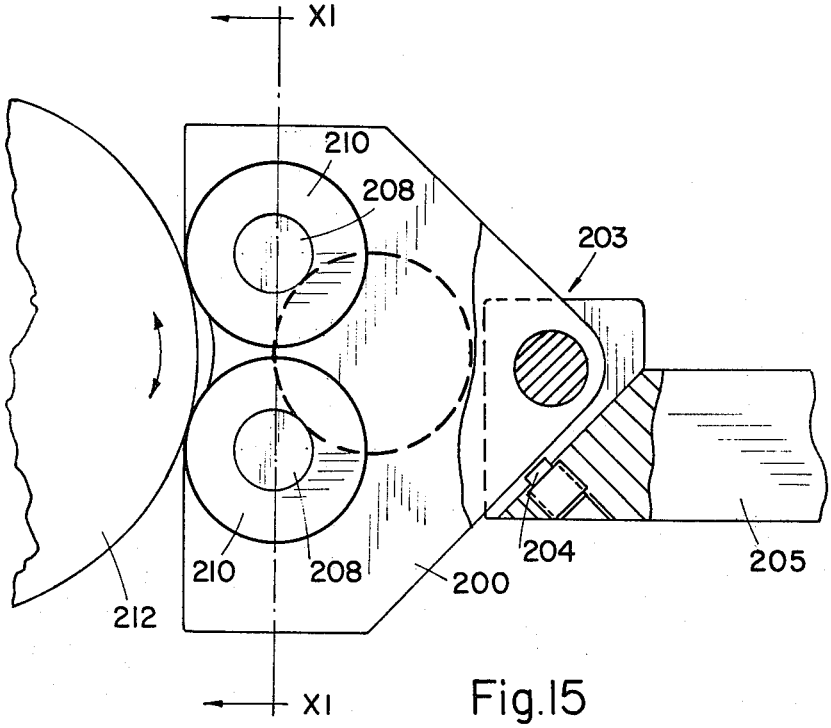
FIG. 15 is a sectional side view of a polishing tool constructed and operative in accordance with an embodiment of of the invention.
Figure 16:
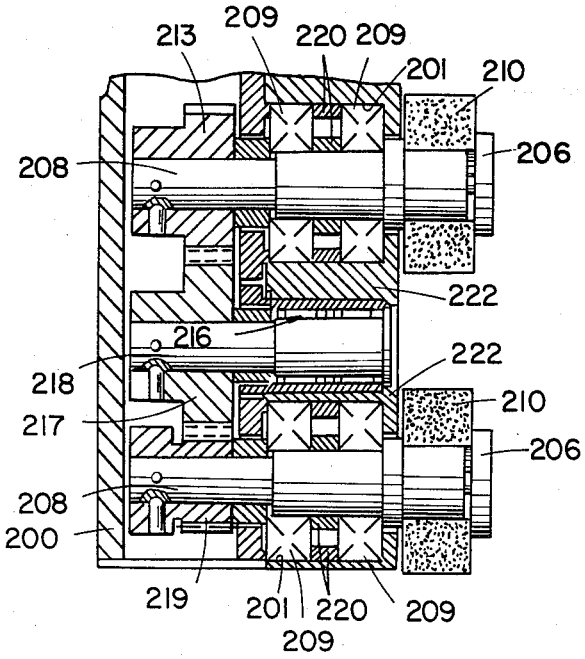
FIG. 16 is a sectional view of the polishing tool of FIG. 15 taken along the lines XI–XI indicated in FIG. 15.

Referring now to FIGS. 15 and 16 which show a turn-shaving head constructed and operative in accordance with an embodiment of the invention, it is seen that the turn-shaving head comprises a housing 200 in which are mounted at least two roller assemblies 210. Roller assemblies 210 are arranged on housing 200 so as to simultaneously contact a rotating workpiece 212 mounted for rotation on a conventional lathe such as a metal lathe. Housing 200 is in turn rotatably mounted by means of mounting means 203 comprising a ball and socket or other suitable apparatus onto a tool holder 205 which may be inserted into a conventional tool holding clamp on the lathe. The orientation of housing 203 and thus of rollers 210 with respect to workpiece 212 may initially be limited in at least one direction by means of a positioning screw 204 threadably engaging tool holder 205, and abutting against the surface of housing 200. In the embodiment shown only two rollers are employed. However, it is appreciated that any number of rollers exceeding two may alternatively be employed in accordance with an alternative embodiment of the invention.

Rollers 210 are fixedly mounted on shafts 208 by means of retaining members 206 and retaining pins 207. Shafts 208 are in turn mounted within respective bores 201 formed in housing 200 by means of bearings 209 which may be angularly oriented by means of differently sized rings 220. The orientation and mounting of bearings 209 is similar in this aspect to that of bearing 24 in the embodiment of FIG. 10. The bearing assemblies are retained in fixed relationship to housing 200 by means of retaining assemblies 222.

Shafts 208 are coupled to each other by means of gear means which establish a definite gear ratio therebetween. The gear means may typically comprise first and second gears 213 and 219 attached to respective shafts 208 and an idler 217 engaging gears 213 and 219 and mounted on a shaft 218 which is in turn seated on an assembly of needle bearings 216.

The apparatus as described hereinabove may comprise multi-groove shaver rollers as rollers 210. These may be formed of hard alloys or alternatively may comprise polishing discs having dispersed therein the grains of an abrasive. Each roller turns about its axis at a speed which is related to the speed of the other by a definite preselected gear ratio. The rollers may be substantially similar to those illustrated in FIGS. 1–9 hereinabove and preferably engage the workpiece under similar pressures, producing similar compression of the rollers as that described hereinabove. Conical rollers may also be employed.

In accordance with the embodiment of the invention shown the axes of rotation of the rollers are parallel. According to alternative embodiments of the invention such axes need not necessarily be parallel.

Both rollers simultaneously seek to turn with the speed of the machine surface at the point of contact. Since the speeds of the rollers are restricted by the gearing to differ in a defined ratio there inevitably results a slippage of at least one roller surface with respect to the rotating workpiece surface, thereby resulting in cutting action.

The heads may be designed in a wide variety of ways and may be of the same or different diameter. One of the rollers may be formed of a material with a high friction factor such as steel for use as a drive roller, thereby causing the other roller or rollers to produce most of the cutting action. The rollers may be of different thickness so as to equalize the force moments generated by the cutting action of the rollers under the given gear ratio therebetween and so as to ensure slipping by both rollers. It is also possible to employ two abrasive polishing discs formed on a relatively soft base or to use a multi-groove roller shaver and a polishing disc in combination.

It is appreciated that in all of the design variants disclosed the turn-shaving head has no independent drive and the rotation of the rollers is solely by contact thereof with a moving workpiece surface.

In accordance with one embodiment of the invention where the roller's respective width is equal both rollers rotate at a definite calculated intermediate speed and produce a determined amount of slipping motion with respect to the workpiece surface.

Polishing rollers can be made of various materials including porous polyurethane, the pores of which are filled with a liquid abrasive. Discs of borozon or diamond discs on a rubber or epoxy base can alternatively be used.

According to a further embodiment of the invention the desired slipping of various rollers can be selectably and adjustably determined by the use of an adjustable brake which is accessible during set-up and operation.

According to a further alternative embodiment of the invention the millshaving heads exemplarily illustrated in FIGS. 10–14 hereabove may be constructed additionally to have gearing interconnecting the shaver rollers so as to determine the ratio of their rotational speeds.

Additional alternative embodiments of the invention particularly related to the machining of bodies of revolution will now be described in connection with FIGS. 17–23.

According to the embodiments which will be described hereinafter, polishing discs may be selected to ensure simultaneous contact with a machined surface at a multiplicity of points, the radii of which differ with respect to the axis of free rotation of the tool, thus resulting in slippage of individual sections of the tool's surface against the workpiece during relative motion therebetween. The tool's surfaces may be configured to be cylindrical, tapered, spherical, ellipsoidal, toroidal, with a radial generatrix or any other suitable shape. For further example, the external tool surface may be a single-cavity hyperboloid of revolution having a rectilinear generatrix at an angle to the axis or a cone of similar configuration.

In addition to the basic variants, alternative designs proposed make it possible to lead the cylindrical or tapered tool along with the rotating motion around its axis, also an oscillating axial movement. This is achieved, for example, by the use of a face end cam or a pneumatic or electromagnetic system providing for partial braking within the limits of the cycle. A variant is proposed in which the braking of the spindle responsible for the cutting speed is effected by a pneumatic or hydraulic pump with an adjustable resistor on the output, or a brake with a centrifugal speed adjustment.

Also considered is the use of tools with a freely rotating spindle for the machining of face surfaces. In addition to other applications the proposed method of finish polishing can also be used for the machining of bearing rings and rollers, for example, spherical roller bearings.

Figure 17:
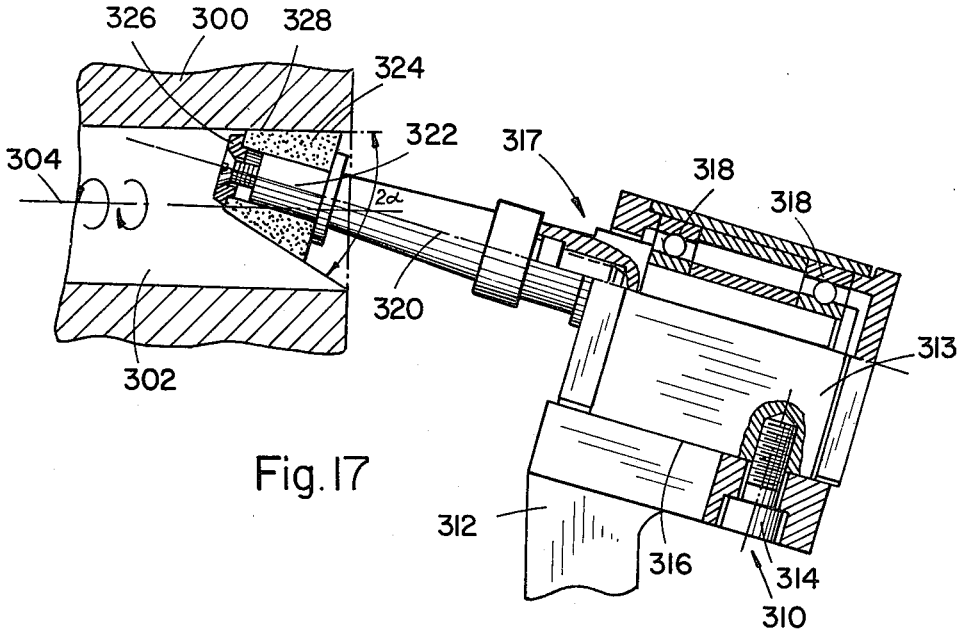
FIG. 17 is a side view of a polishing tool for finishing the interior surface of a workpiece.

Reference is now made to FIG. 17 which is a partial sectional view of a finishing tool for a turning lathe. A workpiece 300 having formed therein a bore 302, whose inner surface it is sought to finish, is secured in the chuck (not shown) of a conventional lathe for rotation about an axis 304. The finishing tool, indicated generally by reference numeral 310 comprises a tool holder 312 which is secured in an appropriate mounting socket (not shown) arranged on the lathe. A finishing assembly 313 is mounted onto tool holder 312 at a selectable angular disposition thereto by means of a securing bolt 314. Loosening of bolt 314 permits rotation of finishing assembly 313 relative to tool holder 312 to define a desired angle with axis 304.

Spindle assembly 317 defines a mounting location 322 arranged symmetrically about axis 320. A selected finishing head 324 may be mounted at location 322 onto spindle assembly 317 for rotation about axis 320 and may be secured onto the spindle assembly by means of a retaining screw 326.

Finishing head 324 is arranged to have a tapered configuration defining a rectilinear generatrix 328. A tapered finishing head of truncated conical configuration is employed in this application, as illustrated.

It is to be appreciated that the finishing tool is a passive element and the rotation of finishing head 324 about axis 320 is produced by frictional contact under pressure between the finishing head and the inner surface of bore 302 which is driven for rotation about axis 304. The relative velocity between the surface of the finishing head and that of bore 302 at the various points lying along generatrix 328 are not equal, but varies as a function of the radial separation between each given point and axis 320. Therefore at nearly every point of contact between the finishing head and the bore surface cutting is provided. The singular point of contact where no slippage of the finishing head relative to the machined surface takes place has no constant position due in part to the irregularities in the finishing head surface and movement of the finishing tool axially relative to the workpiece.

Figure 18A:
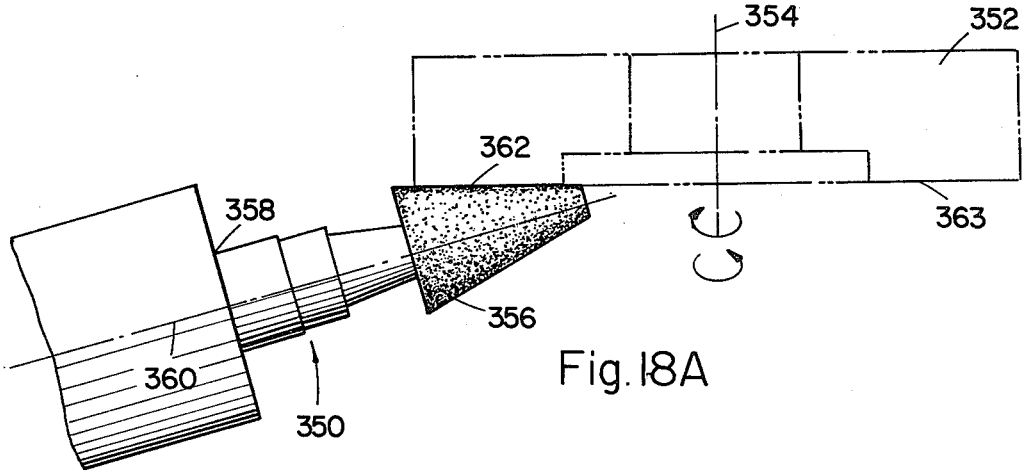
FIGS. 18A and 18B are respective side view and top view illustrations of a polishing tool in association with a workpiece surface.
Figure 18B:
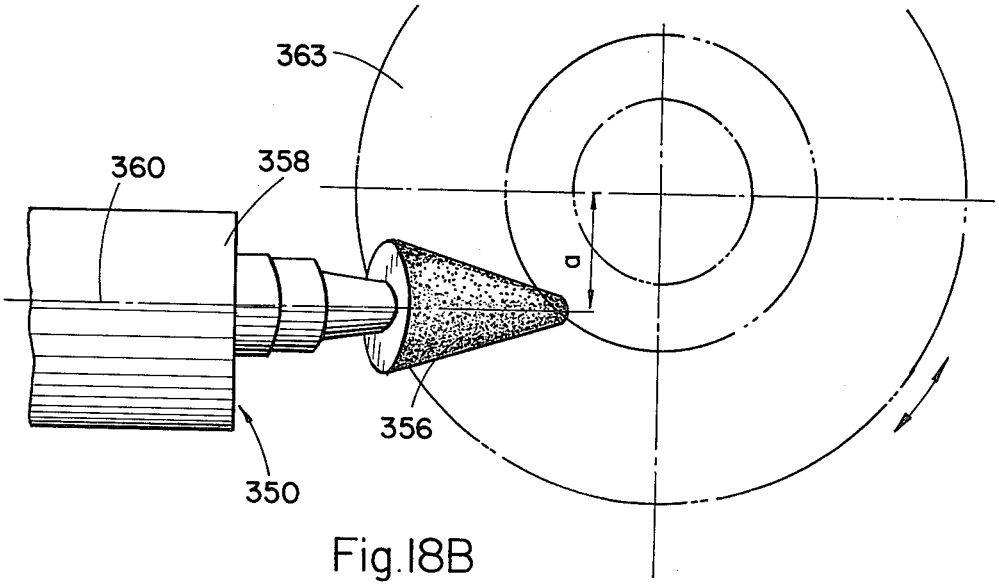

Reference is now made to FIGS. 18A and 18B which show a finishing tool 350 of the general type illustrated in FIG. 17 arranged for machining of a plane butt surface 363 of a workpiece 352 mounted for rotation about an axis 354 on a turning lathe. A finishing head 356 mounted onto a spindle assembly 358 and forming part of tool 350 is arranged for rotation about an axis 360 selected such that the generatrix 362 of head 356 is arranged in continuous touching relationship to the surface 363 to be machined.

It may be appreciated particularly from FIG. 18B that tool 350 is oriented such that generatrix 362 does not lie along a radius of the rotating workpiece. Such non-radial alignment of axis 360 has been found to produce a higher quality of finish than would occur were radial alignment employed. This is due to the difference in the cutting velocities at various points of contact between the finishing head 356 and the surface 363 to be machined. It is also appreciated that instead of a generally conical finishing head 356, a generally cylindrical head may alternatively be employed. It has been found that a high quality surface finish in the range of 2–4 microinch r.m.s. or higher can be obtained using the apparatus of FIGS. 18A and 18B.

Figure 19:
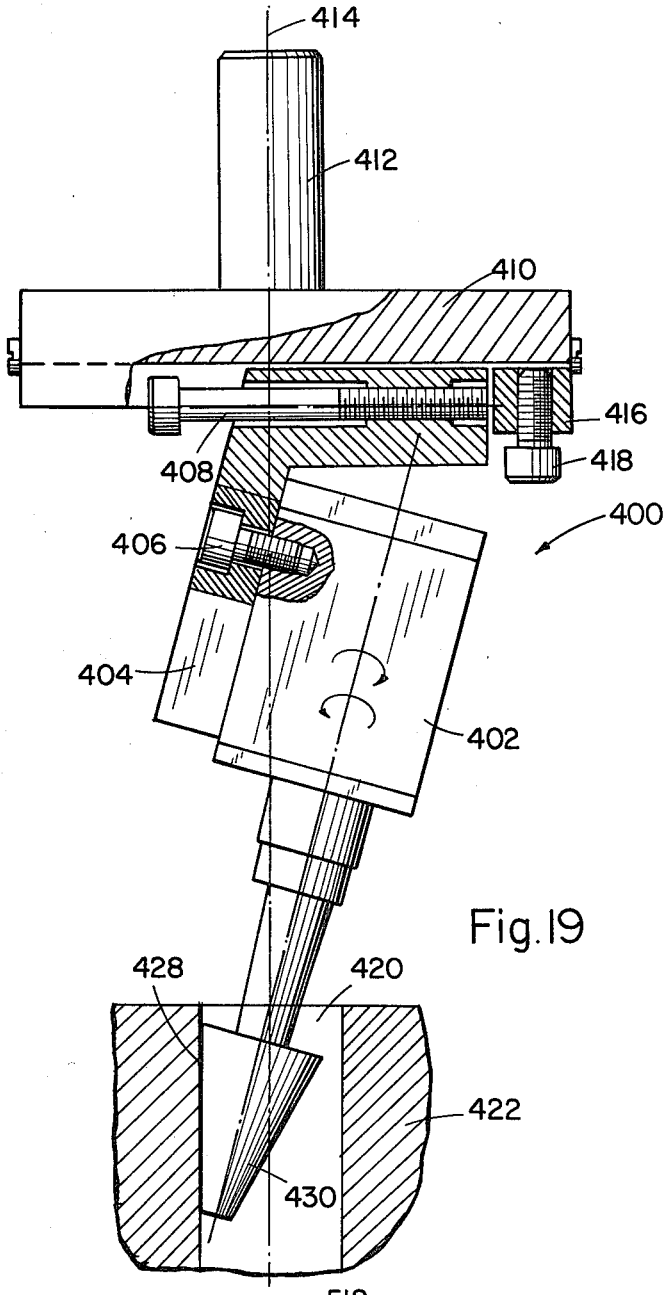
FIG. 19 is a partially cut away side view illustration of a polishing tool for finishing the interior surface of a workpiece.

Reference is now made to FIG. 19 which shows in a partially cut away side view a finishing tool 400 constructed and operative in accordance with an alternative embodiment of the invention for use on milling or boring machines. A spindle assembly 402 with associated finishing head 430 is mounted on a mounting bracket 404 by means of a securing pin 406. Spindle assembly 402 may be substantially identical with spindle assembly 313 of FIG. 17 and may be mounted onto bracket 404 by pin 406 in a manner similar to the mounting of assembly 313 onto tool holder 312 as illustrated in FIG. 17.

Mounting bracket 404 in turn selectably positioned, by means of a mounting screw 408, onto a rotatable support member 410 which is in turn attached to a shank 412, thereby enabling insertion into the rotatable chuck of a suitable machine tool for driving rotation of the tool when so inserted. Shank 412 is arranged along an axis 414 which is identical to the axis of rotation of the machine tool. Bracket 404 is adjustably positionable in a plane perpendicular to axis 414. A range of possible positions of bracket 404 is determined by a stop member 416 which is positioned onto member 410 by means of a bolt 418.

Tool 400 is set up for operation by first aligning axis 414 with the axis of a bore 420 formed in a workpiece 422 to be machined. Bracket 404 is positioned in the plane perpendicular to axis 414 such that a generatrix 428 is defined by finishing head 430 in engagement with the wall of bore 420. Screw 408 is then tightened to secure bracket 404 in a desired position. Rotation of tool 400 about axis 414 produces relatively rapid finishing of the bore at speeds in the range of 2,500 r.p.m.

Figure 20:
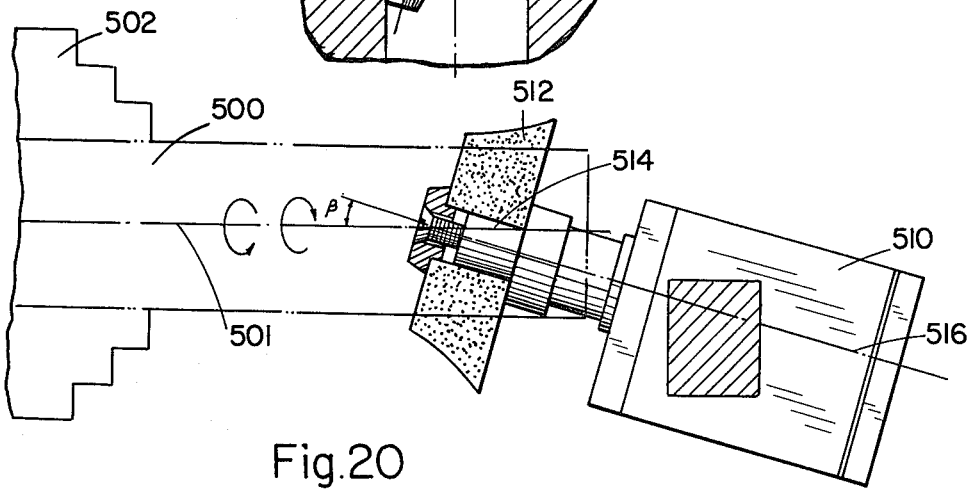
FIG. 20 is a side view of a polishing tool for finishing the exterior surface of a body of revolution.
Figure 21:
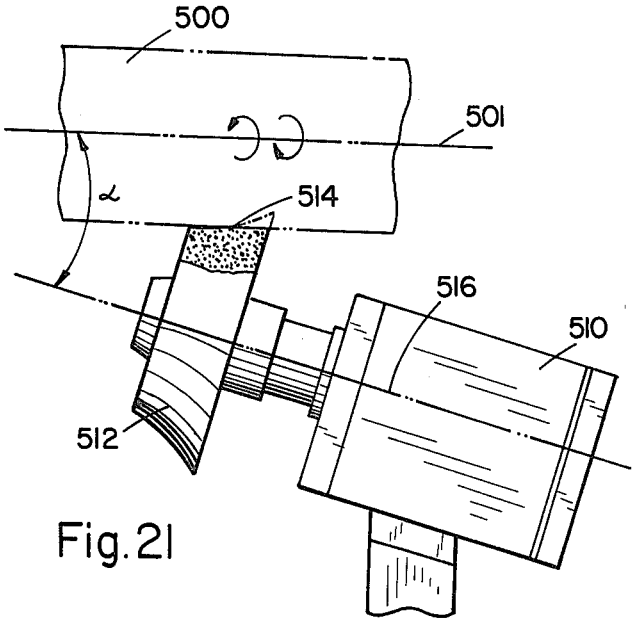
FIG. 21 is a top view of the tool of FIG. 20.

Reference is now made to FIGS. 20 and 21 which provide respective side and top views of a finishing tool associated with a shaft whose external cylindrical surface is to be machined. A workpiece 500 is arranged for rotation about an axis 501 and is secured by the expandable chuck 502 of a conventional turning lathe (not shown). A spindle assembly 510 and associated finishing head 512 are positioned such that a rectilinear generatrix of contact between the finishing head 512 and the surface to be machined is defined. The finishing head 512 is arranged for rotation about an axis 516 which is oriented in accordance with a preferred embodiment of the invention so as not to intersect axis 501.

In the exemplary embodiment illustrated in FIGS. 20 and 21 the projection of axis 516 in the horizontal plane, illustrated in FIG. 16, is oriented at an angle $\alpha$ with respect to axis 501 while the projection of the axis 516 in the vertical plane forms an angle B with axis 501.

Finishing head 512 as illustrated in FIGS. 20 and 21 is formed as part of a single-recess hyperboloid or revolution and the generatrix 514 thereof lies parallel to the generatrix of the surface being machined.

According to one embodiment of the invention the finishing head can be formed so as to have a desired degree of compressability and elasticity. The finishing head may comprise a base of a relatively soft, elastic material such as a resinoid, rubber or polyurethane. Grains of abrasive such as, for example, diamond, borozone and silicone dioxide are fixedly attached to the base to define a finishing surface.

In accordance with an alternative embodiment of the invention a finishing head formed of relatively compressible elastic material such as that described hereinabove and of a generally truncated conical configuration may be substituted for the finishing head 512 in the applications illustrated in FIGS. 20 and 21. Such a compressible and elastic finishing head would tend to assume, during use, the desired hyperboloid configuration illustrated herein.

Figure 22A:
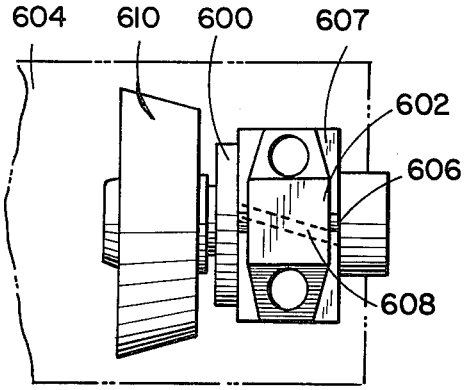
FIGS. 22A and 22B are two alternative mounting orientations for an adjustably positionable polishing tool constructed and operative in accordance with an embodiment of the invention.
Figure 22B:
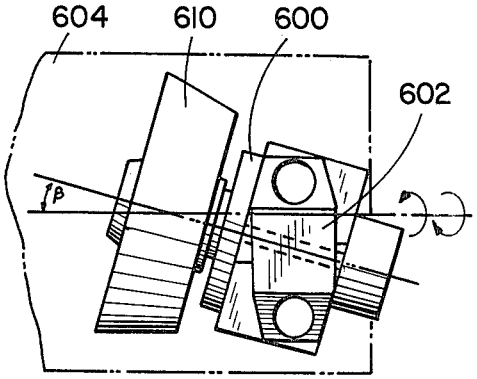

Reference is now made to FIGS. 22A and 22B which illustrate a spindle assembly 600 and associated tool holder mounting means 602 in alternative selectable positions with respect to a workpiece 604. Mounting means 602 is fixedly attached to a tool holder (not shown) which is in turn located in a suitable mounting socket on a lathe. The mounting means may comprise a pair of channels 606 and 608 angled with respect to each other by a predetermined amount, to which a mounting element 607 fixedly attached to spindle assembly 600 may be selectably associated for selectable angular disposition of the spindle assembly 600 and of associated finishing head 610 with respect to the tool holder and also with respect to the workpiece 604.

Referring once again to FIGS. 20 and 21 as an example, it may be appreciated that the arrangement illustrated in FIG. 22A corresponds to a case in which the angle B=0 while the arrangement illustrated in FIG. 22B corresponds to the arrangement where the angle B is non-zero. It may also be appreciated that the arrangement in FIG. 22A can correspond to a case wherein, again referring to FIGS. 20 and 21, the axes 516 and 501 intersect while in contrast the arrangement illustrated in FIG. 22B may relate to a case wherein axes 516 and 501 do not intersect.

Figure 23:
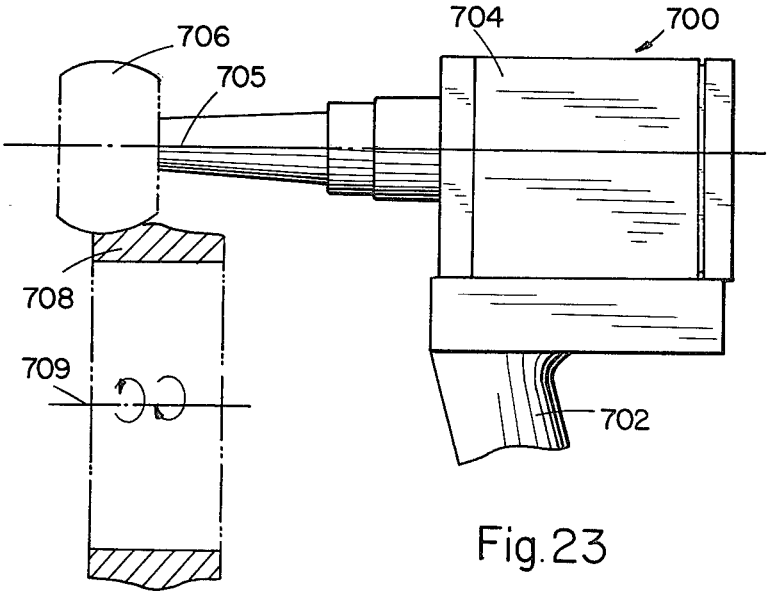

Reference is now made to FIG. 23 which shows a finishing tool 700 comprising a tool holder 702, a spindle assembly 704 and a finishing head 706. As is seen, finishing head 706 is formed as a spherical section. This configuration is particularly useful for polishing of the inner races 708 of a spherical roller bearing assembly.

Typically the race 708 is mounted for rotation on a turning lathe and tool 700 is arranged such that finishing head 706 contacts the races in a desired arrangement. Two possible relative orientations between the race and the finishing head are noted. One possibility is that the axis 705 about which finishing head 706 rotates lies in the same plane as the axis 709 of rotation of race 708. Alternatively, axis 705 is oriented such that it crosses axis 709.

It will be appreciated by persons skilled in the art that the invention has been disclose by way of example in a limited number of possible embodiments. Many other embodiments of the invention will occur to persons skilled in the art in the light of the disclosure and within the scope of the present invention. Therefore the invention is limited only by the claims which follow.

I claim:

1. Apparatus for effecting high tolerance finishing of a workpiece surface comprising:

a mounting member including attachment means suitable for attachment to rotary drive apparatus for rotation of the mounting member about a first axis;

at least one resilient abrasive finishing element rotataby mounted on said mounting member for motion relative to said workpiece surface in a plane perpendicular to said first axis;

bearing means supporting said at least one finishing element on said mounting member for free rotation of said at least one finishing element relative to said mounting member; and means for collecting particulate matter generated during a finishing operation from wear of said finishing element mounted on said mounting member;

said at least one resilient abrasive finishing element comprising an annular body of uniformly intermixed resilient and abrasive substances.

2. Apparatus according to claim 1 and wherein said mounting member defines at least one axis of rotation for said polishing element.

3. Apparatus according to claim 2 and wherein said at least one axis comprises first and second axes, said mounting member being arranged for rotation about said first axis and said polishing element bein arranged for rotation relative to said mounting member about said second axis.

4. Apparatus according to claim 3 and wherein said first and second axes are intersecting.

5. Apparatus according to claim 3 and wherein said first and second axes are non-intersecting.

6. Apparatus according to claim 1 and wherein said mounting member defines a housing.

7. Apparatus according to claim 1 and also comprising means for providing pressure engagement between said at least one polishing element and said workpiece surface.

8. Apparatus according to claim 7 and wherein said providing means comprises means for providing rotation of said mounting member in opposite directions.

9. Apparatus according to claim 1 and wherein said collecting means comprises a housing mounted onto said mounting member and defining at least one rectangular opening at the bottom portion thereof, said at least one finishing element being disposed mainly within said housing and extending partially through said at least one rectangular opening, said at least one rectangular opening having a length which is less than the diameter of said at least one finishing element.

10. Apparatus according to claim 1 and wherein the radial depth of said annular body is at least as great as its width.

11. Apparatus according to claim 1 wherein the resilient and abrasive substances are selected in order to provide a surface finish of 2–4 microinch rms.

12. Apparatus according to claim 7 and wherein said means for providing pressure engagement is operative to produce a compression of 200–300 microns in the overall diameter of said at least one finishing element during operation against a workpiece.

13. Apparatus according to claim 7 and wherein said means for providing pressure engagement is operative to provide area contact between said finishing element and a workpiece surface.

14. Apparatus according to claim 9 and wherein said bottom is selectably positionable with respect to the remainder of said housing.

15. Apparatus according to claim 9 and wherein the interior of said housing is configured to define a recess for collection of particulate matter produced during operation.

* * * * *